US009843883B1

(12) United States Patent
Su

(10) Patent No.: US 9,843,883 B1
(45) Date of Patent: Dec. 12, 2017

(54) SOURCE INDEPENDENT SOUND FIELD ROTATION FOR VIRTUAL AND AUGMENTED REALITY APPLICATIONS

(71) Applicant: Huan-Yu Su, San Clemente, CA (US)

(72) Inventor: Huan-Yu Su, San Clemente, CA (US)

(73) Assignee: QOSOUND, INC., San Clemente, CA (US)

( * ) Notice: Subject to any disclaimer, the term of this patent is extended or adjusted under 35 U.S.C. 154(b) by 0 days.

(21) Appl. No.: 15/593,696

(22) Filed: May 12, 2017

(51) Int. Cl.
*H04R 5/02* (2006.01)
*H04S 7/00* (2006.01)
*H04S 1/00* (2006.01)

(52) U.S. Cl.
CPC ..... *H04S 7/304* (2013.01); *H04S 1/00* (2013.01)

(58) Field of Classification Search
CPC ..... H04R 1/02
See application file for complete search history.

(56) References Cited

U.S. PATENT DOCUMENTS

2009/0052703 A1* 2/2009 Hammershoi ..... H04S 7/302 381/310
2011/0299707 A1* 12/2011 Meyer ..... H04S 7/304 381/310
2016/0330563 A1* 11/2016 Chen ..... H04S 7/303
2016/0373877 A1* 12/2016 Laitinen ..... H04S 7/304
2017/0078825 A1* 3/2017 Mangiat ..... H04S 7/40
2017/0188168 A1* 6/2017 Lyren ..... H04S 1/007
2017/0195816 A1* 7/2017 Shih ..... H04S 7/303
2017/0208415 A1* 7/2017 Ojala ..... H04S 7/304
2017/0208417 A1* 7/2017 Thakur ..... H04S 7/306
2017/0215020 A1* 7/2017 Robinson ..... H04S 7/308
2017/0236162 A1* 8/2017 Christensen ..... G06Q 30/0269 705/14.66
2017/0245081 A1* 8/2017 Lyren ..... H04S 1/005
2017/0257724 A1* 9/2017 Bosnjak ..... H04S 7/304

* cited by examiner

*Primary Examiner* — Olisa Anwah
(74) *Attorney, Agent, or Firm* — Keith Kind

(57) ABSTRACT

Provided is an improved method for source-independent sound field rotation for virtual and augmented reality applications. The method provides sound field rotation for any type of audio recording source without requiring special processing for different audio formats. The method provides an effective approach to rotate any audio source while preserving directional sound source information.

13 Claims, 11 Drawing Sheets

Stereo recording with a very different left-right channel arrangement 202

Simple re-mixing creates identical left-right channels or will reduce their differences 303

SOURCE INDEPENDENT SOUND FIELD ROTATION FOR VIRTUAL AND AUGMENTED REALITY APPLICATIONS

CROSS REFERENCE TO OTHER APPLICATIONS

The present application for patent claims priority to Provisional Application No. 62/336,670 entitled "SOURCE INDEPENDENT SOUND FIELD ROTATION FOR VIRTUAL/AUGMENTED REALITY (AR/VR) APPLICATIONS" filed on May 15, 2016 by Huan-yu Su. The above referenced provisional patent application is incorporated herein by reference as if set forth in full.

FIELD OF THE INVENTION

The present invention is related to audio signal processing and more specifically to a system for audio source independent sound field rotation for virtual and augmented reality devices.

SUMMARY OF THE INVENTION

Virtual Reality ("VR") and Augmented Reality ("AR") (hereinafter referred to both individually and collectively as "VR/AR"), are becoming multibillion dollar industries. Advances in video graphics, video signal processing, and the ever increasing computer processing power, have recently enabled not only high quality consumer products, but the general commercialization of VR/AR devices and applications worldwide. Such applications are not limited to computer gaming, but have many additional applications such as virtual meetings, field training in different environments, virtual travel, instant information retrieval based on real-world surroundings, and enhanced online shopping, just to name a few.

Virtual Reality hardware generally offers visual and audio immersion through head-mounted three dimensional (3D) display units that typically include ear/headphones for the related audio. Such units include sensors to track users head movements for adjusting the visual and audio signals accordingly. Augmented Reality hardware on the other hand, generally includes some type of display unit that allows the user to visually experience the actual real world around them, but super-imposes visual and/or audio data to provide a composite/augmented view of the world.

In order to render a realistic virtual experience, the video field needs to be responsive to the user's head movements by changing the user's view point accordingly. For example, consider a VR application where a user is placed within a music hall during a live concert event. In this example, the user is presented with a video stream having the center stage placed in the middle of the scene. When the user moves his or her head in different directions, the video stream also moves, but in the opposite direction (relative to the user's eyes), in order to provide a realistic experience of being within the concert environment. If the user looks to the right, the center stage moves to the left and vice-versa.

In addition to video field adjustments as discussed above, the audio field should also be adjusted to further the real-world illusion in VR. That is, not only should the presented (or perceived) video stream be responsive to the user's head movements, but the presented (or perceived) sound field must also be responsive to the user's head movements to simulate a real-world experience in a VR environment.

Following the above example, a user is presented with an audio stream that provides a perception that the musical sound from the concert is coming from the front when the user is looking at center stage. Suppose another sound source is also present in the form of a person speaking from the user's left-hand side. In this example, if the user turns his or her head to the left, the presented video stream moves towards the right, so that the talker is now in directly in front of the user and the sound stage is now to the right of the user. In addition, the audio sound field must be adjusted such that the sound emanating from the talker is now directly in front of the user and the main concert sound is coming from the right side by the same amount as the movement in the video field.

Normal sound sources are recorded, stored and distributed in various formats. Such formats include, for example, monaural sound, or mono (1.0) comprising a single channel or track, stereo (2.0) comprising two separate audio tracks, enhanced stereo (2.1) comprising two stereo tracks and a separate track for low frequency sounds, and various other surround sound modes including, for example, surround sound (5.1), (6.1), or (7.1) comprising multiple right and left tracks both in front and behind the user in addition to one of more low frequency track(s). For the sake of simplicity, the examples used herein discuss stereo and mono tracks; however, all types of formats can be used to implement various embodiments of the present invention, including all current and future, known and unknown types of stereo and surround-sound modes.

Stereo recordings can either be coherent or non-coherent. Coherent Stereo recordings are recordings where the same sound elements are generally present (albeit in different variations as discussed below), in both channels simultaneously because the distances between the microphones are generally fixed and limited. For example, suppose a stereo recording is produced with a piano being played on the right side of the stage and a violin being played on the left. In this case, both channels contain both instruments, but the piano's volume will be higher in the right channel and lower in the left; likewise the violin's volume will be higher in the left channel and lower in the right.

Non-coherent stereo recordings are generally mastered in a professional studio, where each channel can contain completely different sound elements. For example, the left channel contains only audio from a violin, while the right channel contains only audio from a piano.

Human beings perceive the direction of audio sources by relying on, among other things, the spatial difference between the ears. Thus, if only the left channel of a recording contains violin sounds, as in the non-coherent example above, it is not possible to rotate the perceived sound field without inserting some portion of the violin sound to the right channel, thereby making the signal coherent. Unfortunately, a straightforward copy or mixing of some portion of the violin sounds from the left channel to the right channel will inevitably render the violin sounds towards the middle, which results in the perceived sound source being centered and thereby reducing or eliminating some of its original directional cues. This resulting perception is problematic as it is quite different from the original sound characteristics.

What is needed therefore is an improved method to accurately rotate all formats of sound fields, while maintaining the original sound directional cues, where the input audio signals are source-independent and where the same processing techniques work equally well with all types of input audio formats including coherent and non-coherent mono, stereo and surround sound recordings.

DETAILED DESCRIPTION

The present invention may be described herein in terms of functional block components and various processing steps. It should be appreciated that such functional blocks may be realized by any number of hardware components or software elements configured to perform the specified functions. For example, the present invention may employ various integrated circuit components, e.g., memory elements, digital signal processing elements, logic elements, look-up tables, and the like, which may carry out a variety of functions under the control of one or more microprocessors or other control devices. In addition, those skilled in the art will appreciate that the present invention may be practiced in conjunction with any number of data and audio protocols, and that the system described herein is merely one exemplary application for the invention.

It should be appreciated that the particular implementations shown and described herein are illustrative of the invention and its best mode and are not intended to otherwise limit the scope of the present invention in any way. Indeed, for the sake of brevity, conventional techniques for signal processing, data transmission, signaling, packet-based transmission, network control, and other functional aspects of the systems (and components of the individual operating components of the systems) may not be described in detail herein, but are readily known by skilled practitioners in the relevant arts. Furthermore, the connecting lines shown in the various figures contained herein are intended to represent exemplary functional relationships and/or physical couplings between the various elements. It should be noted that many alternative or additional functional relationships or physical connections may be present in a practical system.

Figure 1A:
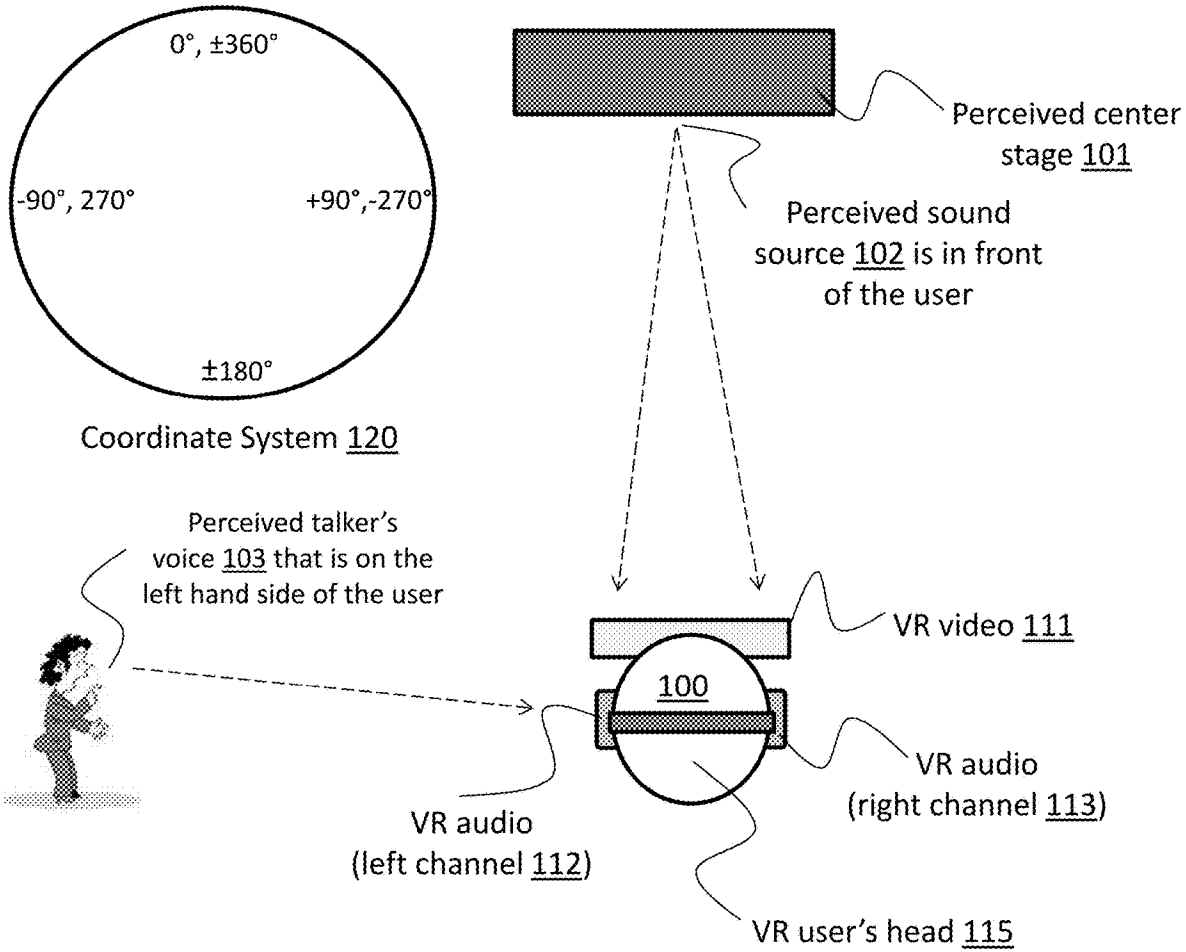
FIGS. 1A and 1B illustrate the requirement for sound field rotation in VR/AR applications.

FIG. 1A illustrates an example where a VR/AR user 100 is looking toward the perceived center stage 101 and the perceived sound source 102 is directly in front of him. The VR/AR audio signal is therefore presented to both left and right channels of the VR/AR audio subsystem 112 and 113, respectively. At the same time, a talker 103 is talking at the left hand side of the VR/AR user. As such, the corresponding voice should also be presented to the VR/AR user's left and right channels 112 and 113, to simulate a real world scenario because both ears, including the right ear, detects a certain amount of the talker's voice 103. Of course, in this case, the volume of the perceived talker's voice 103 is significantly higher in the left channel 112 then the right channel 113.

In the examples used herein, the following coordinate system 120 is used to describe both a user's head movement angle and the angle of sound field rotations. As shown, 0° or ±360° is considered straight ahead or no rotation. Rotations to the right are in the positive direction from +1 to +180°. Similarly, rotations to the left are in the negative direction from −1 to −180°. As shown, a rotation to the right, for example +90° is equivalent to a rotation to the left −270°. Similarly, a rotation to the left, for example −90°, is equivalent to a rotation to right +270°.

Figure 1B:
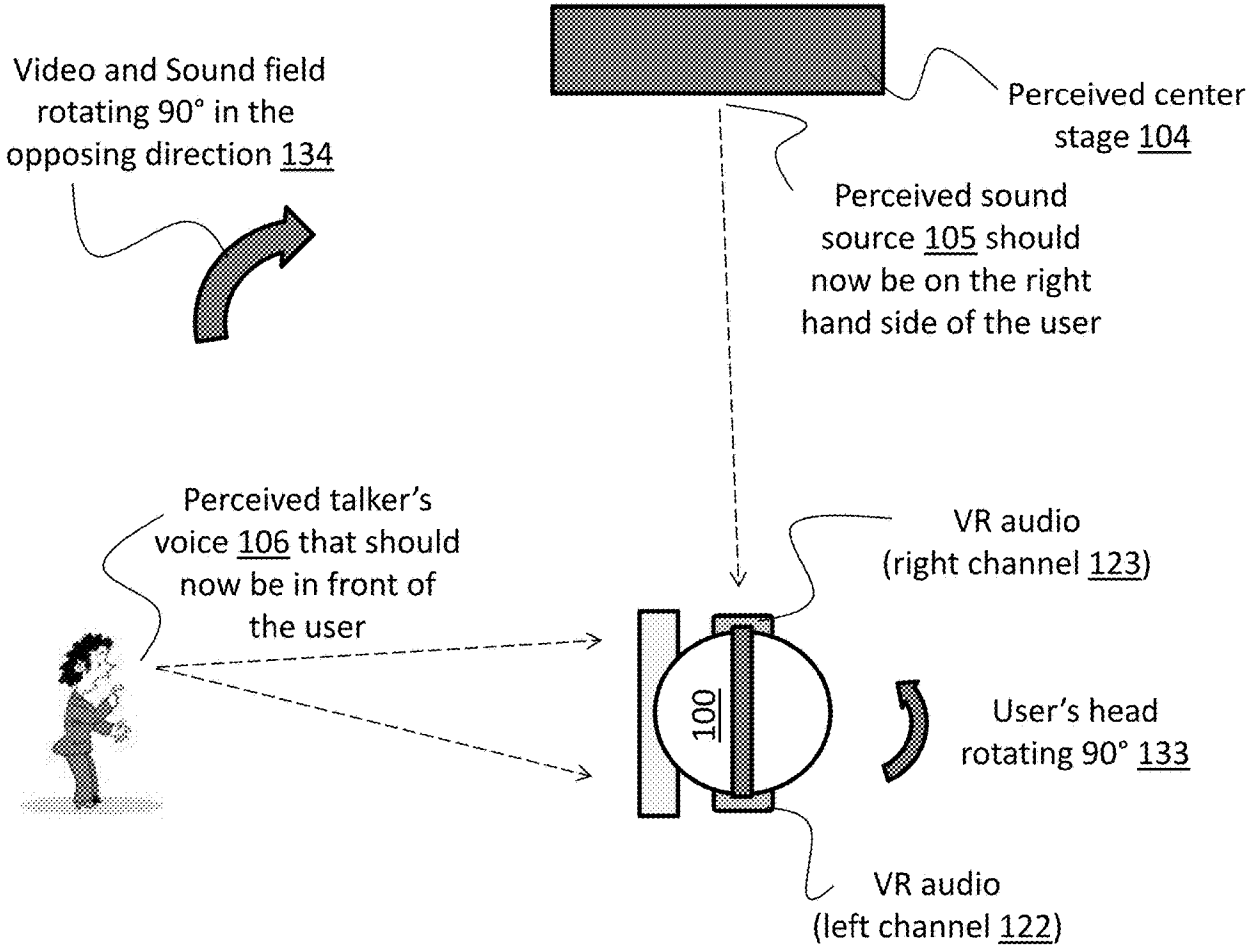

FIG. 1B illustrates the same setting as in FIG. 1A, except that the VR/AR user 100 has now turned his head exactly 90 degrees to the left (−90°). In so doing, the VR/AR video stream is proportionally rotated to the right by the same +90° angle 134, resulting in the center stage 104 now appearing on the right side of the VR/AR user 100, and the talker 106 now appearing directly in front of the user 100.

When a person moves his or her head around in the real-world, not only does the visual perception of the scenery change, but the audio perception changes proportionally. It is therefore required to support both the video stream and audio field rotations proportionally in accordance with the VR/AR user's 100 head movements in order to render a realistic real-world experience, feeling and perception.

As stated, the human auditory system relies on the differences between each ear's perceived audio signals to determine the source of a sound (i.e., the direction and distance of the sound relative to the user). If an audio signal is only presented to only one ear and one ear alone (such as when a user is using headphones or the like), human beings cannot determine the source of the sound.

Figure 2:
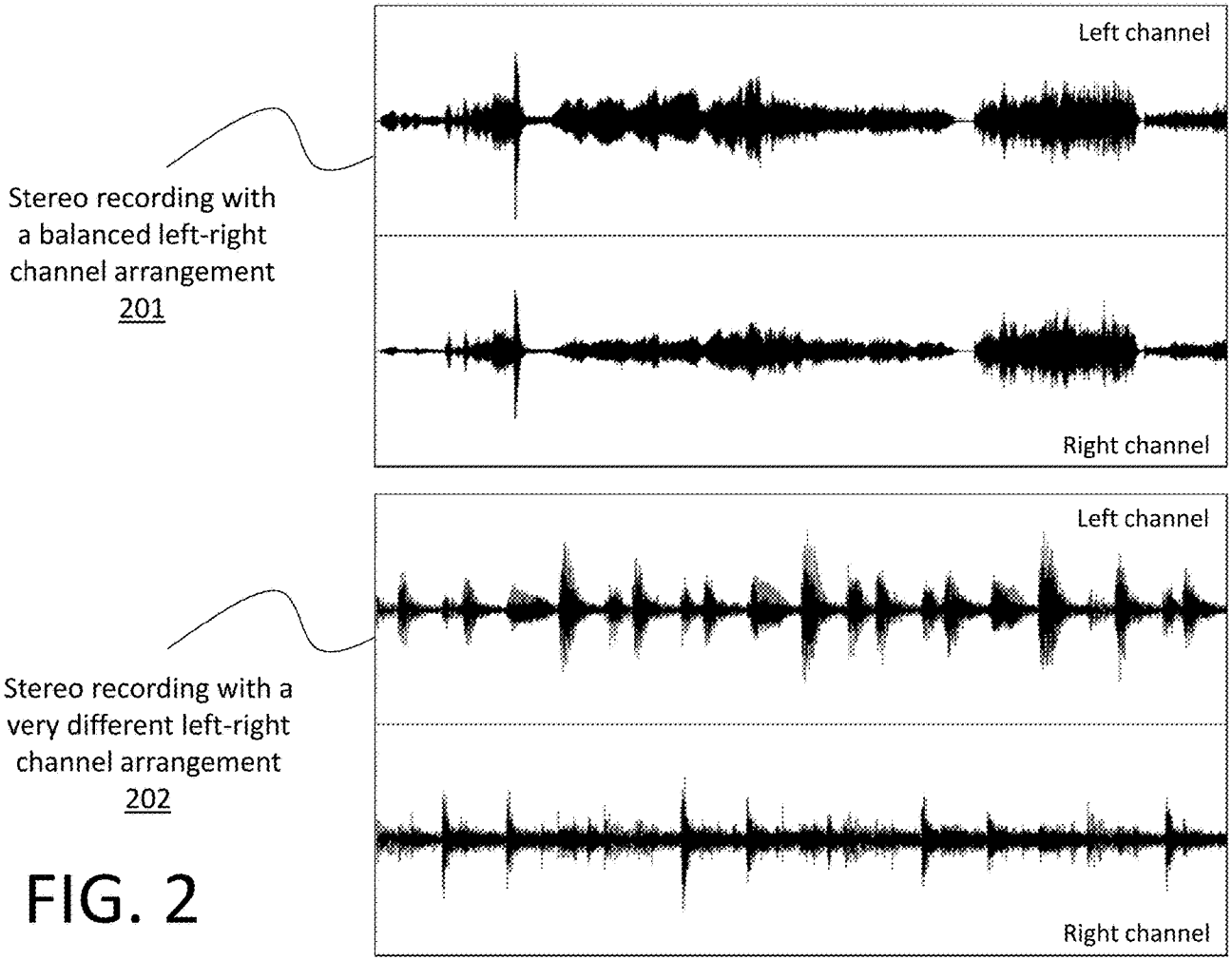
FIG. 2 shows the difference between coherent and non-coherent stereo recording arrangements.

FIG. 2 shows two different stereo recording arrangements commonly found in the music and other content provider industries. In the first example 201, a balanced left and right binaural channel arrangement is presented. Here, both left and right channels contain certain portions of the same audio sources (i.e. instruments and vocals). The audio waveforms as shown in 201 results, for example, when one employs a typical industry stereo recording device with two microphones, one representing the left channel and the other representing the right channel, where microphone is set at a fixed and limited distance apart from the other microphone. Using this method, both channels record all of the instruments and the vocals at the same time, but each channel has a slight variation of the sounds including variations in volume, phase, spectrum, and reverberation, due to the different distances between the audio sources and the microphones.

In the second example, the audio waveforms 202 represent an example that can result from certain studio produced recordings, where the left and the right binaural channels have completely different audio content. This arrangement is widely used in the movie and music distribution industries since it augments a real-world perception of direction when such recordings are played back through stereo and surround sound speaker systems. However, as stated above, VR/AR devices typically use ear/headphone systems and the like, for in-ear playback of the audio tracks. In this case, having both channels comprise completely independent, non-coherent, audio signals that does not allow for an effective sound field rotation using conventional methods.

For example, one method to render both channels coherent is to copy some portion of the left channel signal and mix it with the right channel signal, and vise versa. However, a disadvantage of this mixing method produces a result where the original left/right channel separation and directional perceptions are moved toward the center or towards the front of the user.

Figure 3:
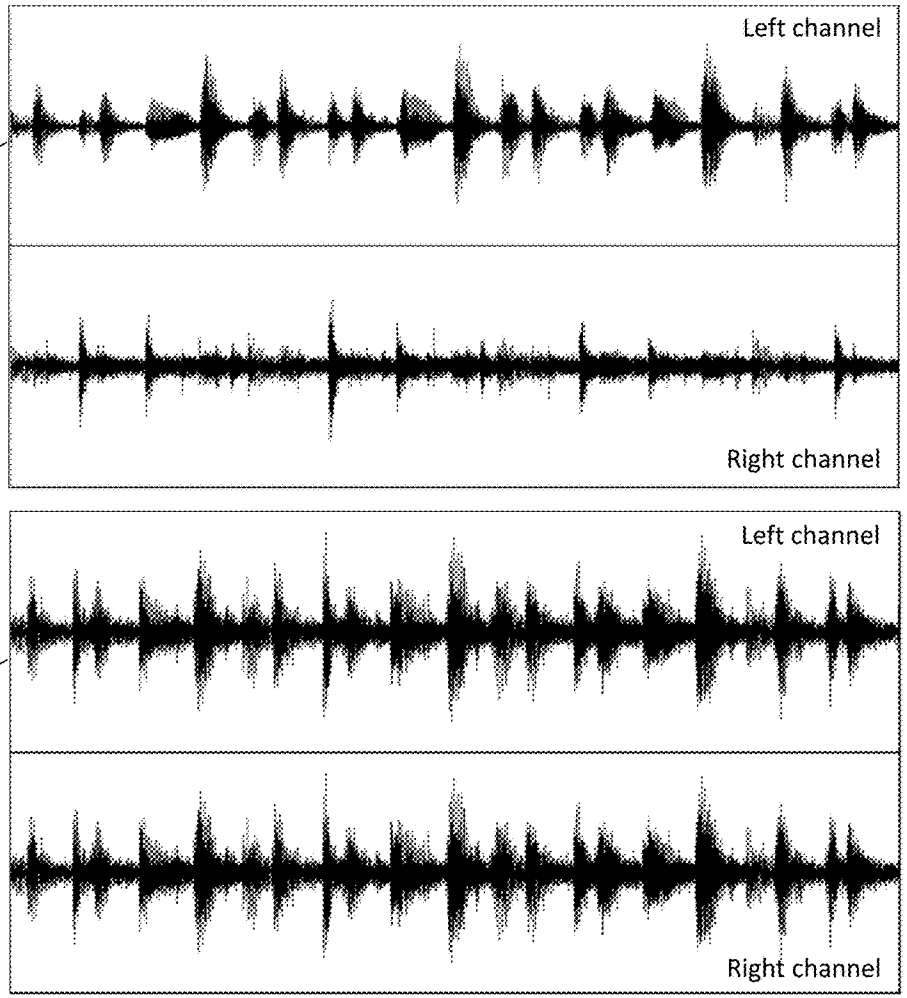
FIG. 3 highlights the drawbacks of a conventional re-mixing of left/right channels to create coherent signals for sound field for rotation.

An example of the above-referenced conventional re-mixing method is shown in FIG. 3. In this example, we start with the same non-coherent stereo production 202, as discussed above, where the right and left channels are completely different from one another. Using a conventional re-mixing method, portions of the left channel audio that are not present in the right channel are copied to the right channel, and portions of the right channel audio that are not present in the left channel, are copied to the left channel. After the re-mix, the resulting left and right channels are identical to each other. Unfortunately, using this method reduces or eliminates the original directional cues that were present in the non-coherent stereo production.

Figure 4:
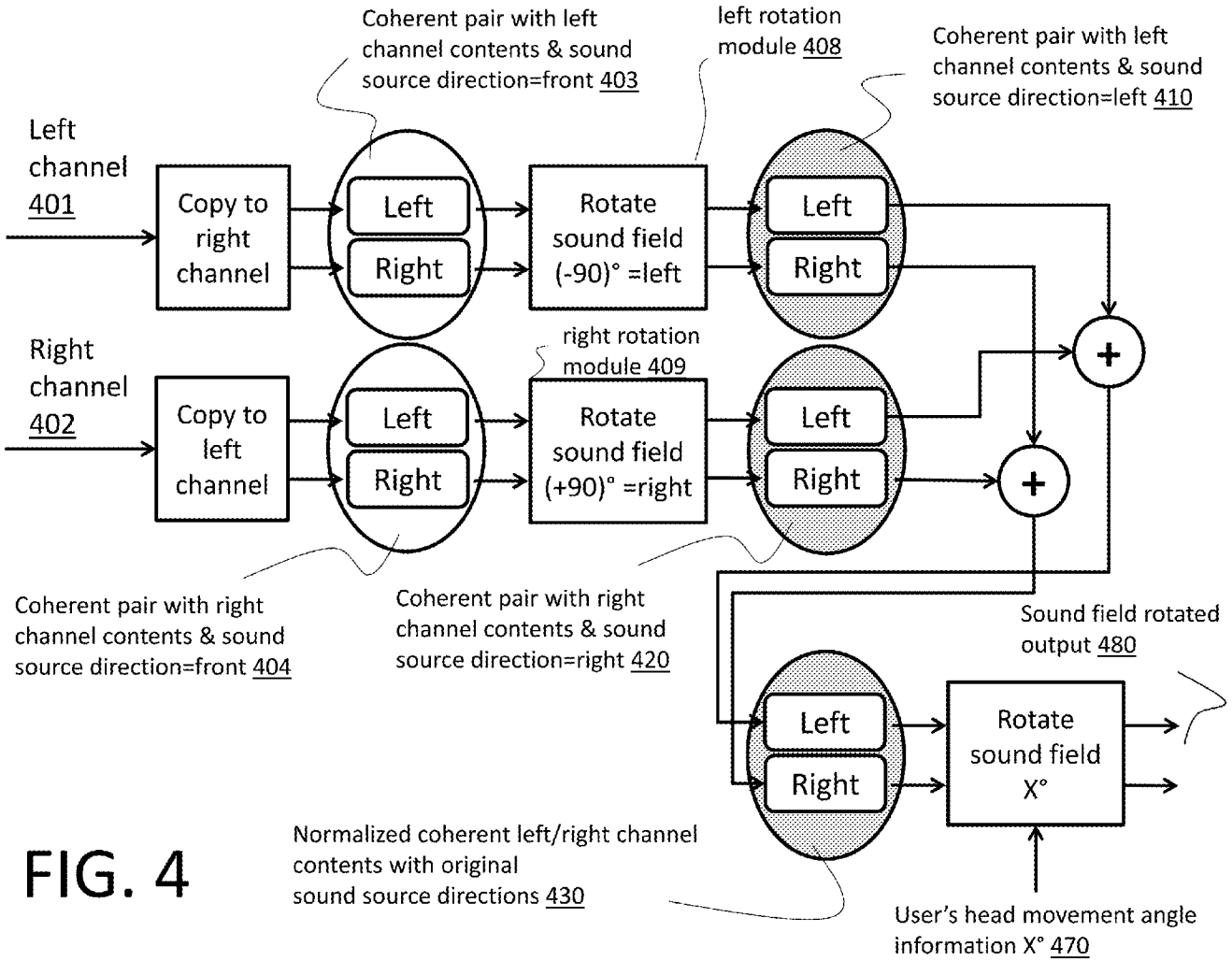
FIG. 4 illustrates an exemplary implementation of the present invention.

FIG. 4 illustrates one example of a preferred embodiment of the present invention that improves the deficiencies of conventional systems and is also source-independent. That is, the present invention operates with any type of originating source material, including coherent, non-coherent, stereo or monaural, etc., types of recordings. It should be noted that in the examples used herein, stereo signals are used for the sake of simplicity. Such stereo signals are not at all limited to simple stereo 2.0 recordings, but also include any type of surround-sound and virtual/simulated surround sound formats including all current and future, known and unknown types that may be encoded within the stereo audio signals as described herein.

Referring now to FIG. 4, we start with a typical coherent or non-coherent stereo recording having a left channel 401 and a right channel 402. First, the left channel is duplicated and copied to a right channel to create identical coherent left/right channel pair 403, comprising audio from the original left channel only. This identical left/right coherent pair would be perceived by a user through ear/headphones or the like, as coming from a direction directly in front of the user.

Next, the sound field is rotated to the left by −90° as shown in 408. This creates an audio source (left-rotated, left-content coherent pair 410), which would be perceived by a user as coming from the extreme left-hand side.

It should be noted that in the examples used herein, the left and right rotation modules 408 and 409, rotate the sound fields −90° and +90°, respectively. However, different rotation amounts, (i.e., any predetermined amount, for example from ±1° to ±179°), can be used to rotate the sound fields, so long as they rotated towards the left and right side of the user, as appropriate, without departing from the scope and breadth of the present invention. In a preferred embodiment, the most optimal and effective predetermined amounts are approximately +90° for the right rotation, and −90° for the left rotation, as described in FIGS. 5 and 6.

Methods to rotate sound fields as in modules 408 and 409 are well known in the art and such methods are not discussed here, however any method to rotate such sound fields are within the scope and breadth of the present invention.

The same process is performed for the right channel 402, but in the opposite direction and rotation. That is, the right channel is duplicated and copied to a left channel to create an identical coherent left/right pair 404, comprising audio from the original right channel only. This identical left/right coherent pair 404 would be perceived as coming from a direction directly in front of a user.

Next, the sound field is rotated to the right by +90° as shown in 408. This creates an audio source (right-rotated, right-content coherent pair 420), which would be perceived by a user as coming from the extreme right-hand side.

In the next step, a mix (or addition) of the right channels in 410 and 420 and the left channels in 410 and 420, creates a coherent binaural signal pair 430 that contains all of the original left and right channel content, and preserves the original directional left and right information for the user.

Specifically, the left-rotated, left-content left channel in 410 is added to the right-rotated, right-content left channel in 420, to create a new left channel in 430 that preserves the original sound content and directional information from both the original right and left channels 401/402. Similarly, the left-rotated, left-content right channel in 410 is added to the right-rotated, right-content, right channel in 420 to create a new right channel in 430 that preserves the original sound content and directional information from the original right and left channels 401/402.

The new coherent pair 430 can be considered a normalized coherent pair 430, which can be used as the audio field whenever a user is looking straight ahead in a VR/AR application. The normalized coherent pair 430 contains all of the audio and audio directional cues that were present in the original right and left channels, whether or not such original content was coherent, non-coherent, stereo or monaural.

In this example, the normalized coherent binaural signal 430 is subsequently processed by a sound field rotating module 470, which simply rotates the sound field in accordance with the user's actual head movement/angle information. That is, the normalized right/left channel pair is rotated X° in accordance with a user's head movement to generate a rotated sound field output signal 480. Methods to rotate a sound field are well known in the art and will not be discussed here, however any method to rotate the sound field X° in accordance with a user's head movement are within the scope and breadth of the present invention.

One advantage of the present invention is that any type or format of audio input source signal can be made coherent to achieve a viable sound field rotation while maintaining the directional source information from the original signal in accordance with an example embodiment of the present invention. If a monaural input is used for example, the monaural signal can be copied to a second channel prior to the first step in the example above, to form the input signal pair 401/402. In this example, after an application of the preferred embodiment of the present invention as described herein, the resulting coherent left and right output signal 430 would also have identical left and right channels, resulting in no impact to the original signal to the user. Similarly, if a balanced stereo input is used, the resulting coherent output 430 would also maintain similar audio characteristics as the original input signal.

It should be noted that the above example of a preferred embodiment of the present invention as described with reference to FIG. 4, where a normalized coherent left/right channel pair 430 is created, can be used to distribute the entire process between one or more entities, or devices, such as between a service provider or content creator and a user AR/VR hardware device/platform.

For example, the original sound source 401/402 may be processed according to the example embodiment described above with reference to FIG. 4, by a service provider or content creator to create the normalized coherent channel pair 430. The normalized coherent channel pair 430 is then delivered to a user via an AR/VR hardware device that only needs to be capable of rotating a sound field as in 470, to generate a sound field rotated output 480 in accordance with the user's actual head movements. This allows for a less complex and efficient AR/VR device/platforms by offloading most of the processing to the service provider and/or content creator. A service provider for example, performs all of the steps prior to the sound field rotation 480 in real time on a remote server or the like, or it can be done ahead of time in a content provider's studio or the like.

On the other hand, it is also possible to have a consumer VR/AR hardware device platform perform all of the steps as described above with reference to FIG. 4, whether it's done in real time or preprocessed at some other time, such as application load/pre-run time, etc. In this case, it is not necessary to perform all of the steps described above, (and some steps may be combined), to more efficiently create the rotated coherent sound field 480 in accordance with a user's head movements. This process is described below with reference to FIG. 5.

Figure 5:
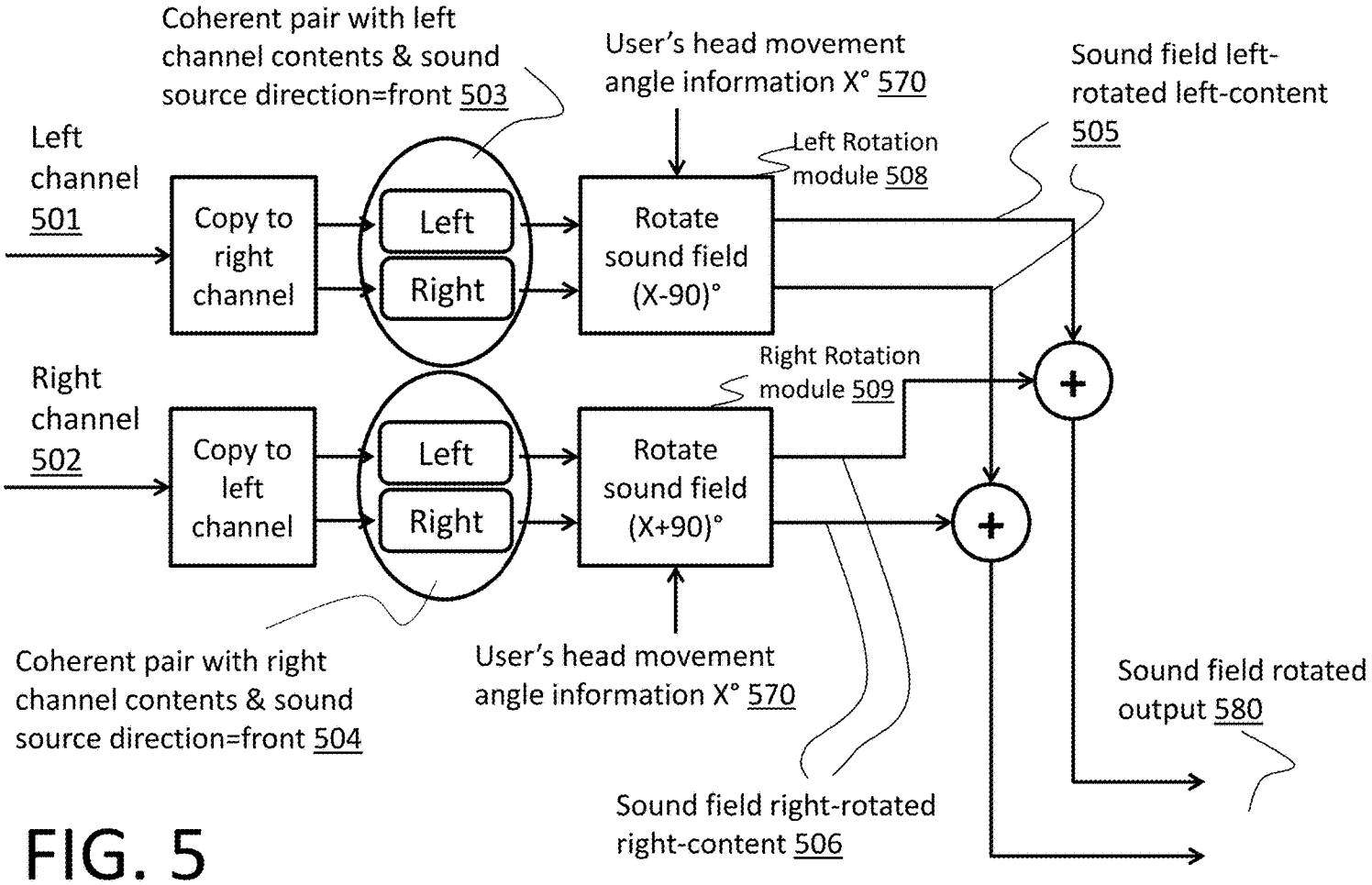
FIG. 5 illustrates another exemplary implementation of the present invention.

FIG. 5 is another exemplary embodiment of the present invention, wherein a similar process is used to create a rotated sound field in accordance with a user's head movements from for a source-independent audio stream while maintaining all of the advantages and improvements of the present invention.

Referring now to FIG. 5, we start in this example with a typical coherent or non-coherent stereo recording having a left channel 501 and a right channel 502. First, the left channel is duplicated and copied to a right channel to create identical coherent left/right pairs of signals 503, comprising audio from the original left channel only. This identical left/right coherent pair would be perceived as coming from a direction directly in front of the user (see 503).

Next, the sound field is rotated (X−90)°, where X is the number of degrees the users head has rotated from the front-looking position of 0°, as detected by the input 570, which is coupled with the AR/VR platform's head-moving sensors (not shown).

The same process is performed for the right channel 502, but in the opposite direction/rotation. That is, the right channel is duplicated and copied to a left channel to create identical coherent left/right pairs of signals 504, comprising audio from the original right channel only. This identical left/right coherent pair would be perceived as coming from a direction directly in front of the user (see 504).

Next, the sound field is rotated (X+90)°, where X is the number of degrees the user's head has rotated from the front-looking position of 0°, as detected by the input 570, which is coupled with the AR/VR platform's head-moving sensors (not shown).

As stated previously, it should be noted that in the example above, the left-content coherent pair 503 and the right-content coherent pair 504 are rotated to the left and right respectively by (X−90)° and (X+90)°. In other embodiments, any predetermined amount other than 90 can be used by the left and right rotation means 508 and 509. However, in a preferred embodiment, the predetermined amount is approximately 90 degrees in either direction.

It should be noted that in the examples used herein, the coordinate system 120 is used to represent the number of degrees of head rotation X, where X is negative when rotating in the left-hand direction, and positive when rotating in the right-hand direction. Therefore, suppose a user turns his head 10° to the left. This is considered X=−10. Thus, in 508 (left rotation module) the sound field is rotated (−10-90)° or −100° (i.e. 100° to the left). Similarly, in 509 (right rotation module), the sound field is rotated (−10+90)° or +80° (i.e. 80° to the right).

Next, the left channel of the sound field left-rotated left-content 505 is mixed with the respective left channel of the sound field right-rotated right-content 506. Similarly, the right channel of the sound field left-rotated left-content 505 is mixed with the respective right channel of the sound field right-rotated right-content 506.

The result of the mixing is a creation of a new rotated output sound field 580 comprising a coherent right/left pair that has been rotated in accordance with a user's head movements, and maintains the directional cues that were present in the original recording signals 501 and 502.

Figure 6:
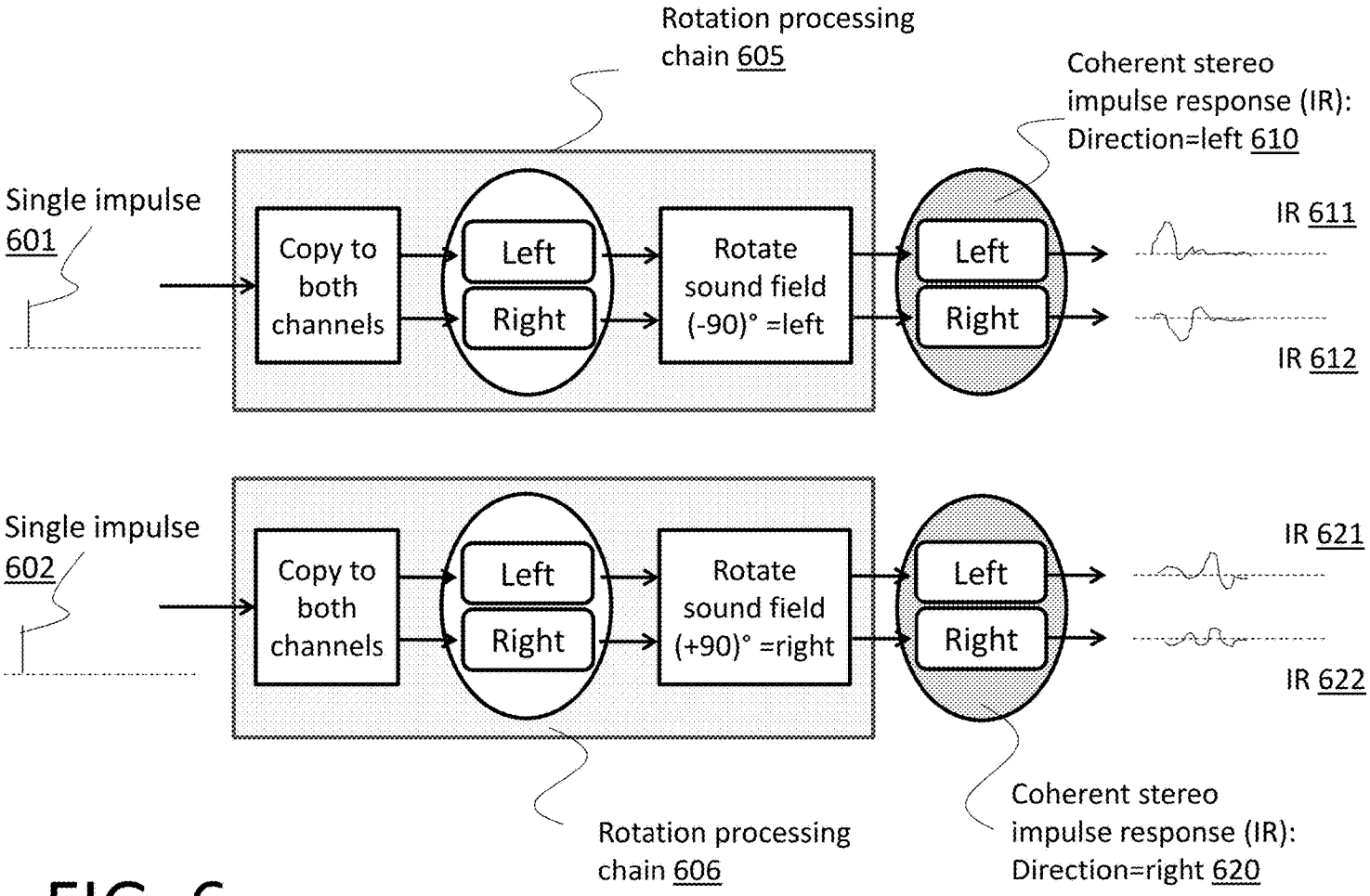
FIG. 6 shows an exemplary embodiment of present invention to generate a set of rotating impulse responses that contains the necessary characteristics of generating a pair of coherent binaural signals.
Figure 7:
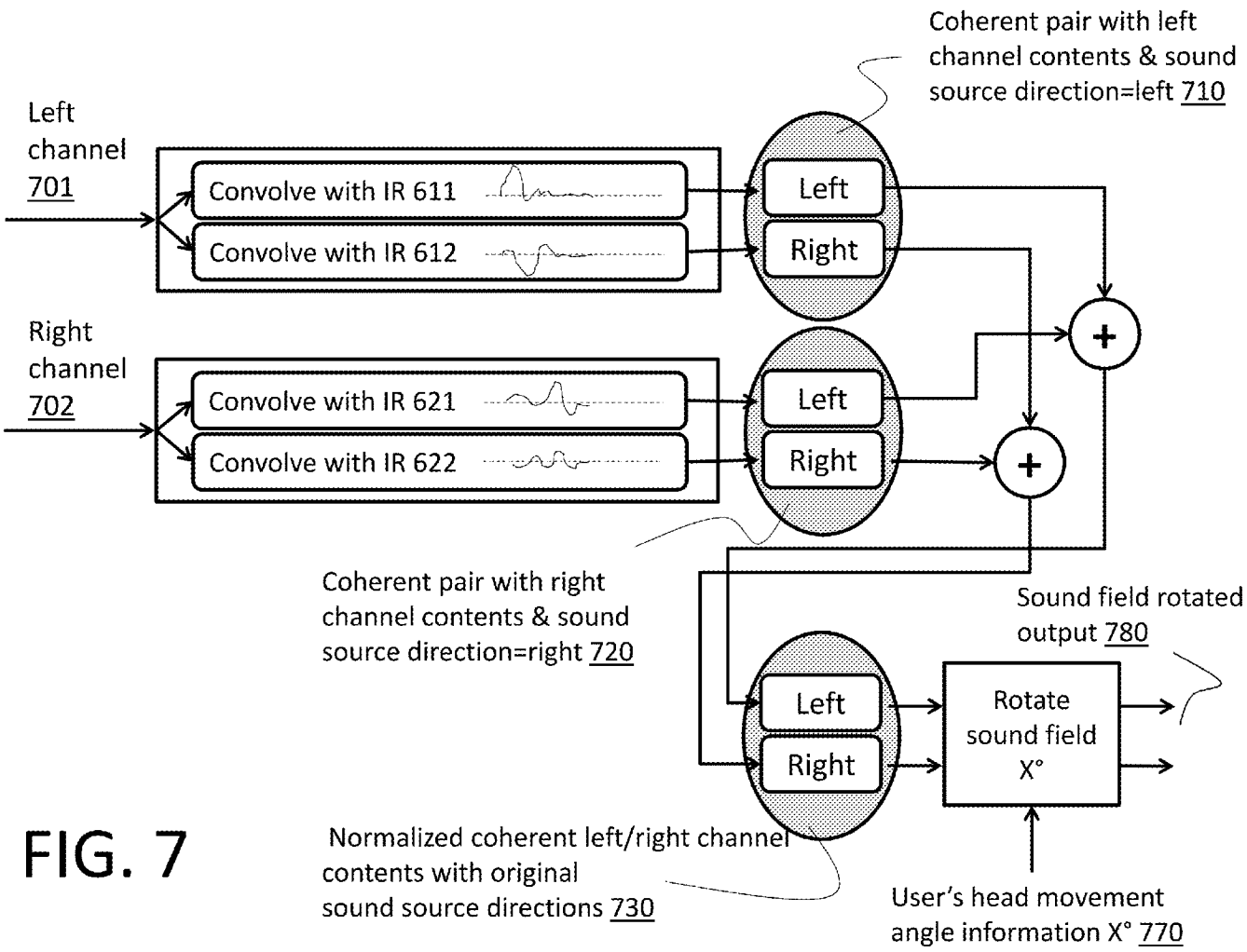
FIG. 7 shows an exemplary method to use the rotating impulse responses set to generate a pair of coherent binaural signals for sound field rotation.

FIGS. 6 and 7 illustrate an alternative embodiment of the present invention where impulse responses are generated and convolved with source-independent audio inputs signals to achieve the same results as described above. Referring now to FIG. 6, a single or unit impulse is input into rotation processing chain 605. The rotation processing chain 605 comprises the same steps or procedures as described above with reference to FIG. 4. First, the single impulse 601 is copied to both left and right channels and then rotated −90° (or another predetermined amount) to the left as indicated in 605. This results in a pair of coherent binaural impulse responses (IR) 610 with a perceived direction of audio from the left (IR 611 and IR612).

Similarly, a single or unit impulse 602 is input into rotation processing chain 606 and copied to both channels, and then rotated to the right 90° (or another predetermined amount). This results in a pair of coherent binaural impulse responses 620 with a perceived direction of audio from the right direction (IR 621 and IR 622).

Referring now to FIG. 7, the impulse responses are convolved with source-independent stereo signals to produce a normalized coherent channel pair as described above. For any input signal, the left channel 701 is convolved with IR 611 and IR 612 to create a coherent pair 710 with the left channel contents and the perceived direction of the sound source from the left. Similarly, the right channel 702 is convolved with IR 621 and IR 622 to create a coherent pair 720 with original right channel contents and the perceived direction of the sound source from the right.

Next, as shown, adding the respective left channels and right channels together creates a coherent binaural signal 730 that includes the original perceived direction of sound sources. The coherent binaural signal 730 can be subsequently processed by a sound field rotating module 770 that considers actual user's head movement angle information and rotates an appropriate X° to generate the sound field rotated output signal 780.

Figure 8:
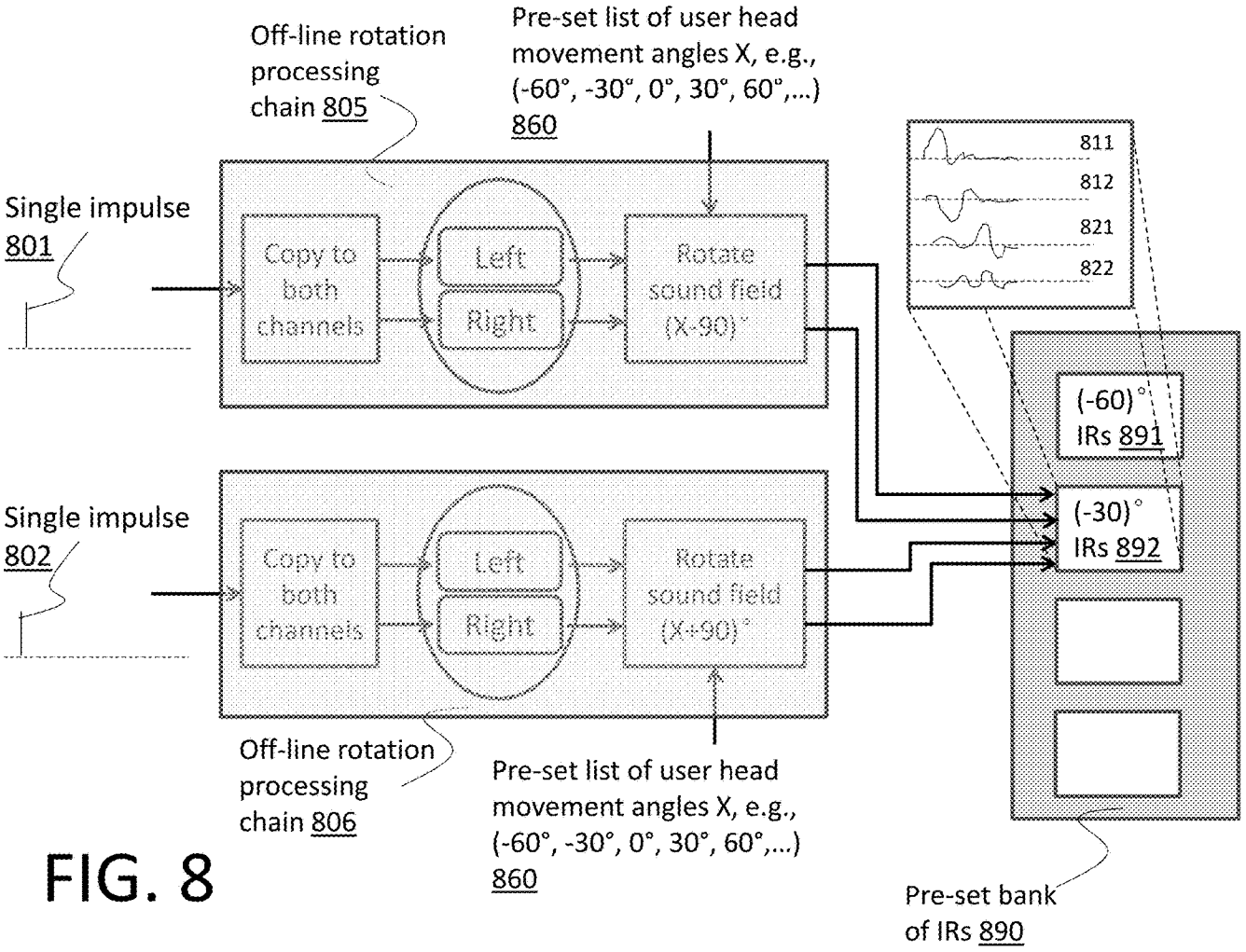
FIG. 8 shows yet another exemplary embodiment of the present invention where a pre-set list of rotation angles is used to generate a pre-set bank of corresponding rotating impulse responses.
Figure 9:
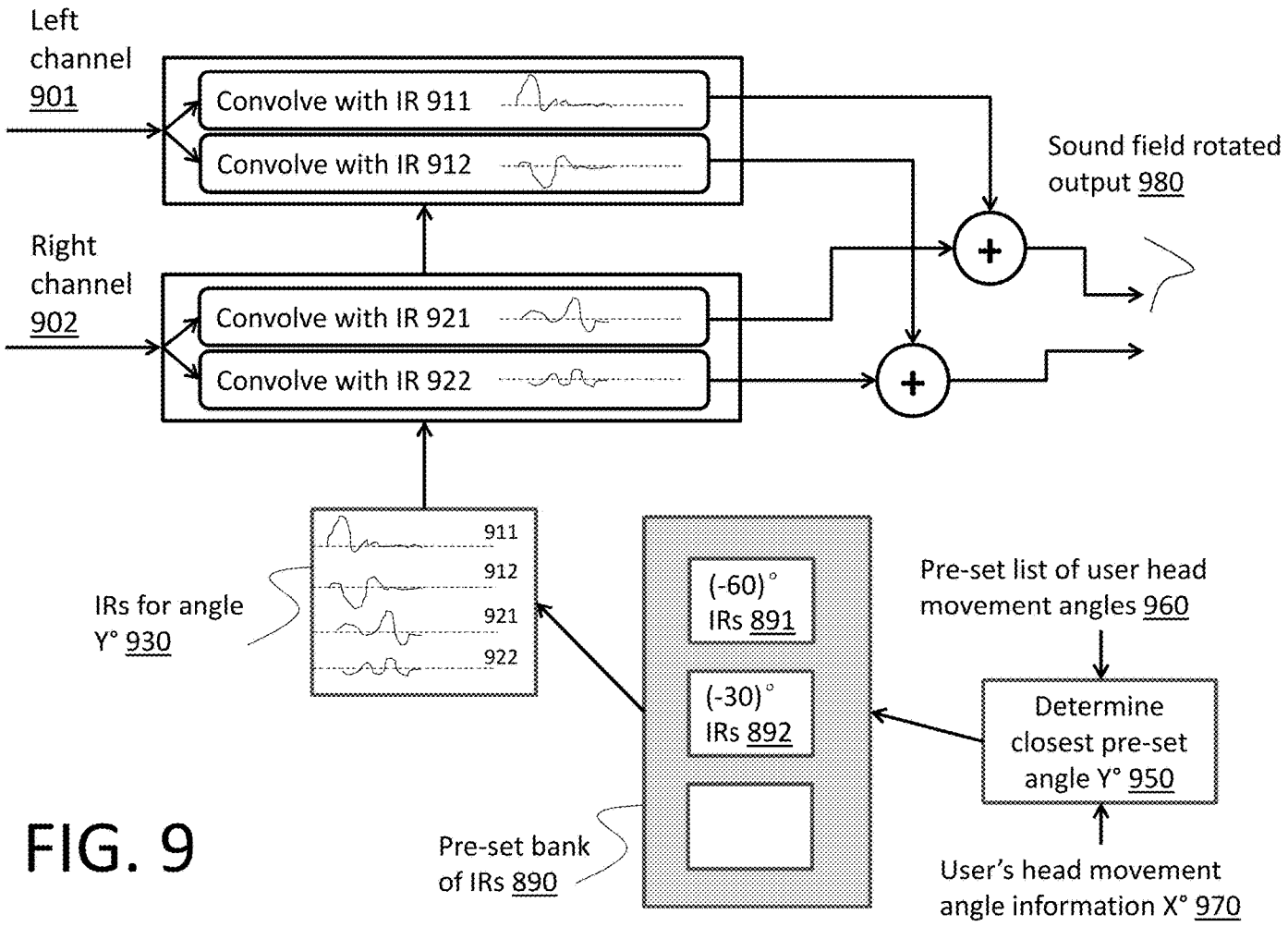
FIG. 9 illustrates an exemplary implementation using pre-set banks of rotating impulse responses to achieve an approximate but lower complexity sound field rotation.

FIGS. 8 and 9 are example embodiments of the present invention that create and store a fixed set of predetermined rotation angles for approximating a user's actual head movement. This can be used to greatly reduce the complexity of certain implementations of the present invention. In addition, it may not be necessary to provide extremely high levels of granularity for certain audio field rotation adjustments in response to user head movements, because humans may not be able to detect any differences beyond a certain threshold limit. In one example embodiment of the present invention, the audio field is adjusted for every 15 degrees of head rotation.

This embodiment of the present invention can also be used, for example, in certain applications that may not require user head movement information at all. For example, an application that displays a simulated virtual environment where the user's head movements are not considered, but the view point is changed in accordance with a predetermined algorithm. This simplified embodiment of the present invention is shown in FIG. 8.

Single impulses 801 and 802 are input into the off-line rotation processing chains 805 and 806. As can be seen with reference to FIG. 6, the processing chains 805 and 806, can be the same as the processing chains as described above, which are capable of considering users actual head movements (as the angle X°) to produce a pair of rotating binaural impulse responses 811/812 and 821/822 with (X−90)° and (X+90)° rotations, respectively.

However, in this example embodiment, a user's actual head movements are not used at this time at all. Instead, and a predetermined set of angles 860, are input into the processing chains 805 and 806, to create a predetermined or pre-set bank of impulse responses 890 to be used later, during execution of an AR/VR application. As indicated, this procedure is preferably performed off-line, (i.e. pre-execution time of an AR/VR application), to create a pre-set bank of IRs 890 in preparation for the AR/VR application.

For example, a pre-set list of angles 860 covering a certain range, for example: (−60°, −30°, 0°, +30°, +60°), is used and all of the corresponding IRs 891/892 . . . for each of the pre-set angles are generated and stored in a pre-set bank of IRs 890.

Now referring to FIG. 9, a user's actual head movement generates a sound field rotation angle X° 970. This information is now used to compare against the pre-set angle information 960 to determine the closest or most appropriate available angle Y° 950. Next, the pre-stored IRs for angle Y° 930 is used to convolve with the left and right channel input audio signals 901 and 902 to produce the sound field rotated output 980.

Figure 10:
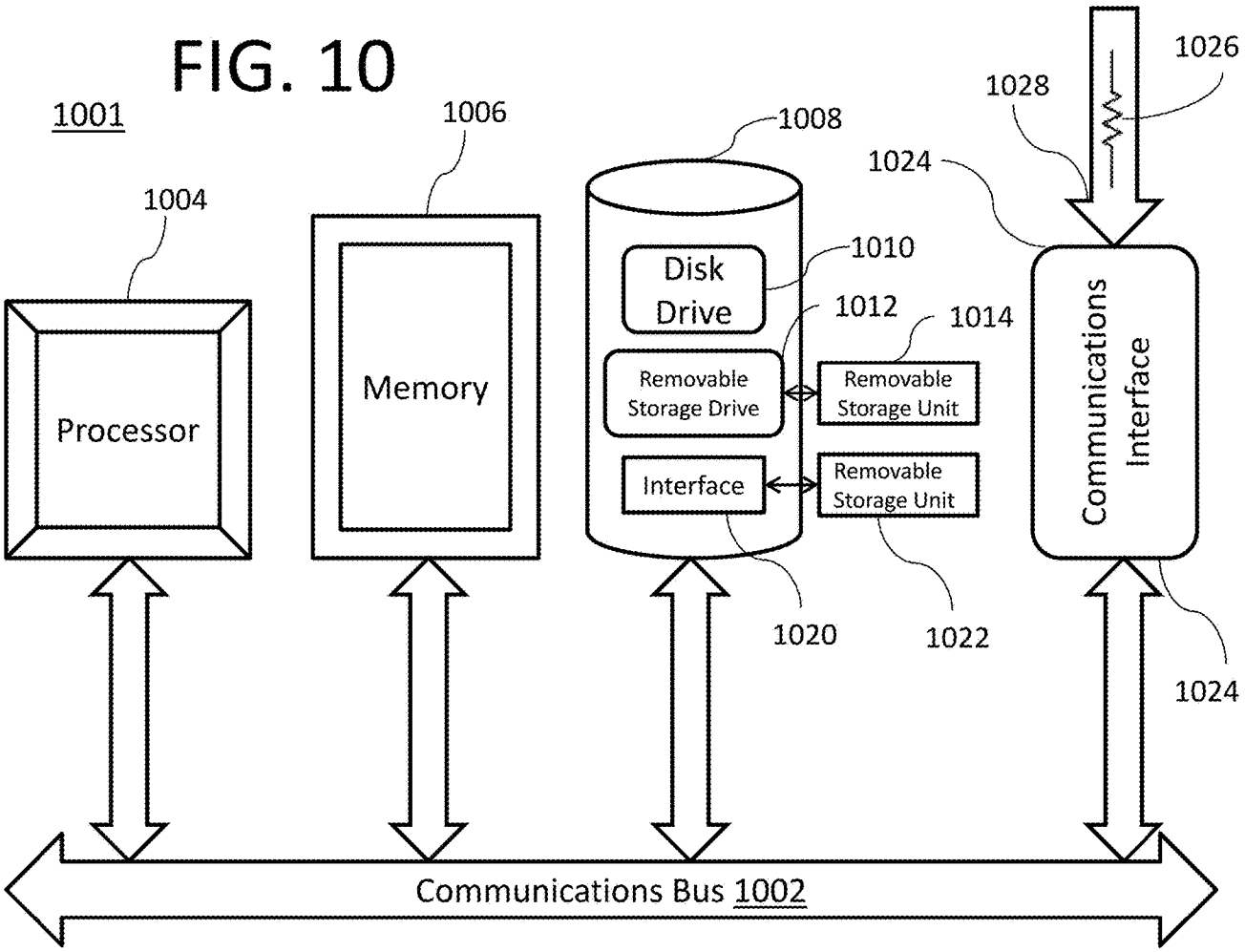
FIG. 10 illustrates a typical computer system capable of implementing an example embodiment of the present invention.

The present invention may be implemented using hardware, software or a combination thereof and may be implemented in a computer system or other processing system. Computers and other processing systems come in many forms, including wireless handsets, portable music players, infotainment devices, tablets, laptop computers, desktop computers and the like. In fact, in one embodiment, the invention is directed toward a computer system capable of carrying out the functionality described herein. An example computer system 1001 is shown in FIG. 10. The computer system 1001 includes one or more processors, such as processor 1004. The processor 1004 is connected to a communications bus 1002. Various software embodiments are described in terms of this example computer system. After reading this description, it will become apparent to a person skilled in the relevant art how to implement the invention using other computer systems and/or computer architectures.

Computer system 1001 also includes a main memory 1006, preferably random access memory (RAM), and can also include a secondary memory 1008. The secondary memory 1008 can include, for example, a hard disk drive 1010 and/or a removable storage drive 1012, representing a magnetic disc or tape drive, an optical disk drive, etc. The removable storage drive 1012 reads from and/or writes to a removable storage unit 1014 in a well-known manner. Removable storage unit 1014, represent magnetic or optical media, such as disks or tapes, etc., which is read by and written to by removable storage drive 1012. As will be appreciated, the removable storage unit 1014 includes a computer usable storage medium having stored therein computer software and/or data.

In alternative embodiments, secondary memory 1008 may include other similar means for allowing computer programs or other instructions to be loaded into computer system 1001. Such means can include, for example, a removable storage unit 1022 and an interface 1020. Examples of such can include a USB flash disc and interface, a program cartridge and cartridge interface (such as that found in video game devices), other types of removable memory chips and associated socket, such as SD memory and the like, and other removable storage units 1022 and interfaces 1020 which allow software and data to be transferred from the removable storage unit 1022 to computer system 1001.

Computer system 1001 can also include a communications interface 1024. Communications interface 1024 allows software and data to be transferred between computer system 1001 and external devices. Examples of communications interface 1024 can include a modem, a network interface (such as an Ethernet card), a communications port, a PCMCIA slot and card, etc. Software and data transferred via communications interface 1024 are in the form of signals which can be electronic, electromagnetic, optical or other signals capable of being received by communications interface 1024. These signals 1026 are provided to communications interface via a channel 1028. This channel 1028 carries signals 1026 and can be implemented using wire or cable, fiber optics, a phone line, a cellular phone link, an RF link, such as WiFi or cellular, and other communications channels.

In this document, the terms "computer program medium" and "computer usable medium" are used to generally refer to media such as removable storage device 1012, a hard disk installed in hard disk drive 1010, and signals 1026. These computer program products are means for providing software or code to computer system 1001.

Computer programs (also called computer control logic or code) are stored in main memory and/or secondary memory 1008. Computer programs can also be received via communications interface 1024. Such computer programs, when executed, enable the computer system 1001 to perform the features of the present invention as discussed herein. In particular, the computer programs, when executed, enable the processor 1004 to perform the features of the present invention. Accordingly, such computer programs represent controllers of the computer system 1001.

In an embodiment where the invention is implemented using software, the software may be stored in a computer program product and loaded into computer system 1001 using removable storage drive 1012, hard drive 1010 or communications interface 1024. The control logic (software), when executed by the processor 1004, causes the processor 1004 to perform the functions of the invention as described herein.

In another embodiment, the invention is implemented primarily in hardware using, for example, hardware components such as application specific integrated circuits (ASICs). Implementation of the hardware state machine so as to perform the functions described herein will be apparent to persons skilled in the relevant art(s).

In yet another embodiment, the invention is implemented using a combination of both hardware and software.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A method for creating a normalized coherent audio channel pair for virtual and augmented reality sound field rotation, said method comprising the steps of:

receiving a binaural audio signal comprising a right-content audio channel and a left-content audio channel;

duplicating said left-content audio channel to create a left-content coherent audio channel pair;

duplicating said right-content audio channel to create a right-content coherent audio channel pair;

rotating said left-content coherent audio channel pair by a left-predetermined amount to create a left-rotated left-content coherent audio channel pair;

rotating said right-content coherent audio channel pair by a right-predetermined amount to create a right-rotated right-content coherent audio channel pair; and creating the normalized coherent audio channel pair by adding corresponding left channels of said left-rotated pair and said right-rotated pair, and corresponding right channels of said left-rotated pair and said right-rotated pair.

2. The method of claim 1, where said left-predetermined amount is approximately minus ninety degrees and said right-predetermined amount is approximately ninety degrees.

3. The method of claim 1, further comprising the steps of:

receiving head movement angle information from a user; and creating a rotated audio field by rotating said normalized coherent audio channel pair in accordance with said head movement angle information.

4. A method for rotating a source independent sound field for virtual and augmented reality applications, said method comprising the steps of:

receiving a binaural audio signal comprising a right-content audio channel and a left-content audio channel;

duplicating said left-content audio channel to create a left-content coherent audio channel pair;

duplicating said right-content audio channel to create a right-content coherent audio channel pair;

rotating said left-content coherent audio channel by (X minus a left-predetermined amount) degrees, wherein X is a number approximately equal to a user's head movement, to create a left-rotated left-content audio pair;

rotating said right-content coherent audio channel pair by (X plus a right-predetermined amount) degrees, wherein X is a number approximately equal to a user's head movement, to create a right-rotated right-content audio pair; and creating a rotated audio field by adding corresponding left channels of said left-rotated pair and said right-rotated pair, and corresponding right channels of said left-rotated pair and said right-rotated pair.

5. The method of claim 4, where said right-predetermined and said left-predetermined amounts are approximately ninety degrees.

6. A method for creating a source independent coherent sound field for virtual and augmented reality applications, said method comprising the steps of:

receiving a first-left single impulse;

duplicating said first-left single impulse to create a first left-single impulse pair;

rotating said first left-single impulse pair by a left-predetermined amount to create a left-rotated coherent impulse response pair;

receiving a second-right single impulse;

duplicating said second-right single impulse to create a second-right single impulse pair;

rotating said second-right single impulse pair by a right-predetermined amount to create a right-rotated coherent impulse response pair;

receiving a left and a right audio channel;

creating a left-rotated left-content coherent sound field by convolving said left audio channel with said left-rotated coherent impulse response pair;

creating a right-rotated right-content coherent sound field by convolving said right audio channel with said right-rotated coherent impulse response pair; and creating a normalized coherent audio channel pair by adding corresponding left channels of said left-rotated pair and said right-rotated pair, and corresponding right channels of said left-rotated pair and said right-rotated pair.

7. The method of claim 6, where said left-predetermined amount is approximately minus ninety degrees and said right-predetermined amount is approximately ninety degrees.

8. The method of claim 6, further comprising the steps of:

receiving head movement angle information from a user; and creating the source independent coherent sound field by rotating said normalized coherent audio channel pair in accordance with said head movement angle information.

9. A method for rotating a source independent sound field for virtual and augmented reality applications, said method comprising the steps of:

receiving a first-left single impulse;

duplicating said first-left single impulse to create a first left-single impulse pair;

rotating said first left-single impulse pair by (X minus a left-predetermined amount) degrees, wherein X is a pre-set list of user head movements, to create a pre-set bank of left-rotated coherent impulse response pairs;

receiving a second-right single impulse;

duplicating said second-right single impulse to create a second-right single impulse pair;

rotating said second-right single impulse pair by (X plus a right-predetermined amount) degrees, wherein X is a pre-set list of user head movements, to create a pre-set bank of right-rotated coherent impulse response pairs;

receiving a user head-movement angle;

determining a closest set of said right-rotated coherent impulse response pairs and left-rotated coherent impulse response pairs from said pre-set banks to said user head-movement angle;

receiving a left and a right audio channel;

creating a left-rotated and right-rotated audio pairs by convolving said set of said closest right and left rotated impulse response pairs with said left and right audio channels; and creating the rotated sound filed by adding corresponding left channels of said left-rotated pair and said right-rotated pair, and corresponding right channels of said left-rotated pair and said right-rotated pair.

10. The method of claim 9, where said left-predetermined amount and said right-predetermined amount are approximately ninety degrees.

11. A non-transitory computer program product comprising a computer useable medium having computer program logic stored therein, said computer program logic for enabling a computer processing device to create a normalized coherent audio channel pair for virtual and augmented reality sound field rotation, said computer program product comprising:

code for receiving a binaural audio signal comprising a right-content audio channel and a left-content audio channel;

code for duplicating said left-content audio channel to create a left-content coherent audio channel pair;

code for duplicating said right-content audio channel to create a right-content coherent audio channel pair;

code for rotating said left-content coherent audio channel pair by a left-predetermined amount to create a left-rotated left-content coherent audio channel pair;

code for rotating said right-content coherent audio channel pair by a right-predetermined amount to create a right-rotated right-content coherent audio channel pair; and code for creating the normalized coherent audio channel pair by adding corresponding left channels of said left-rotated pair and said right-rotated pair, and corresponding right channels of said left-rotated pair and said right-rotated pair.

12. The computer program product of claim 11, where said right-predetermined amount is approximately ninety degrees and said left-predetermined amount is approximately minus ninety degrees.

13. The computer program product of claim 11, further comprising:

code for receiving head movement angle information from a user; and code for creating a rotated audio field by rotating said normalized coherent audio channel pair in accordance with said head movement angle information.

* * * * *